US008561918B2

(12) United States Patent
Göring et al.

(10) Patent No.: US 8,561,918 B2
(45) Date of Patent: Oct. 22, 2013

(54) NOZZLE AND METHOD FOR TREATING AN INTERIOR OF A WORKPIECE

(75) Inventors: Alwin Göring, Vreden (DE); Walter Burger, Heilsbronn (DE); Michael Jarchau, Oelde (DE); Dominic Krautwurst, Schwabach (DE)

(73) Assignee: Hammelmann Maschinenfabrik GmbH, Oelde (DE)

( * ) Notice: Subject to any disclaimer, the term of this patent is extended or adjusted under 35 U.S.C. 154(b) by 1068 days.

(21) Appl. No.: 11/993,162

(22) PCT Filed: Apr. 27, 2006

(86) PCT No.: PCT/EP2006/061888

§ 371 (c)(1),
(2), (4) Date: Aug. 5, 2008

(87) PCT Pub. No.: WO2006/136470

PCT Pub. Date: Dec. 28, 2006

(65) Prior Publication Data

US 2009/0218422 A1 Sep. 3, 2009

(30) Foreign Application Priority Data

Jun. 20, 2005 (DE) ..... 10 2005 028 710

(51) Int. Cl.

| | |
|---|---|
| ***B05B 3/08*** | (2006.01) |
| ***B05B 3/02*** | (2006.01) |
| ***B05B 1/26*** | (2006.01) |
| ***B05B 1/14*** | (2006.01) |

(52) U.S. Cl.
USPC ..... 239/231; 239/230; 239/521; 239/565

(58) Field of Classification Search
USPC ..... 239/225.1, 230, 231, 530.3, 565, 530.5, 239/518, 521; 134/166 R, 167 R, 167 C, 172, 134/176; 266/4, 114, 123, 249, 134, 268
See application file for complete search history.

(56) References Cited

U.S. PATENT DOCUMENTS

| | | | | | |
|---|---|---|---|---|---|
| 1,444,889 | A | * | 2/1923 | Sladden | 134/167 C |
| 2,376,515 | A | * | 5/1945 | Somes | 148/590 |
| 2,926,106 | A | * | 2/1960 | Gauthier | 427/483 |
| 2,954,038 | A | * | 9/1960 | Girard | 134/167 R |
| 3,001,533 | A | * | 9/1961 | Holdren | 134/166 R |
| 3,807,714 | A | * | 4/1974 | Hollyer | 266/134 |
| 5,125,425 | A | * | 6/1992 | Folts et al. | 134/167 C |
| 5,253,716 | A | * | 10/1993 | Mitchell | 169/70 |
| 5,419,496 | A | * | 5/1995 | Novak, Jr. | 239/530 |

(Continued)

FOREIGN PATENT DOCUMENTS

| | | |
|---|---|---|
| DE | 968 508 C | 2/1958 |
| DE | 3507923 A1 | 9/1986 |

*Primary Examiner* — Len Tran
*Assistant Examiner* — Steven M Cernoch
(74) *Attorney, Agent, or Firm* — Barnes & Thornburg LLP

(57) ABSTRACT

A nozzle for treating an interior of a workpiece by means of a highly pressurized fluid medium flowing out of at least one nozzle channel. The nozzle channel branches off from a supply borehole provided in the form of a blind hole. The nozzle is designed in such a manner that the nozzle channel, starting from the bottom end area of the supply borehole, extends at an angle less than or equal to 90° to the supply bore hole in the inflowing direction, the bottom of the supply borehole being provided with an elevation whereby narrowing the transition area to the nozzle channel.

15 Claims, 3 Drawing Sheets

(56) References Cited

Figure 1:
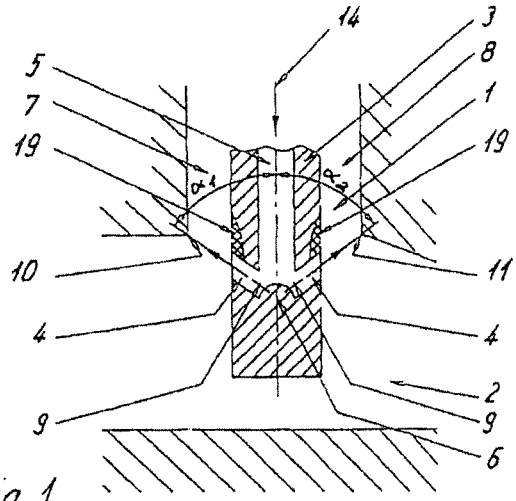

U.S. PATENT DOCUMENTS 5,901,906 A * 5/1999 Bouldin ..... 239/229
5,992,432 A * 11/1999 Horger et al. ..... 134/167 C
6,564,868 B1 5/2003 Ferguson et al.
7,513,261 B2 * 4/2009 Ura ..... 134/22.11
2004/0089450 A1 5/2004 Slade et al.

* cited by examiner

Fig. 3
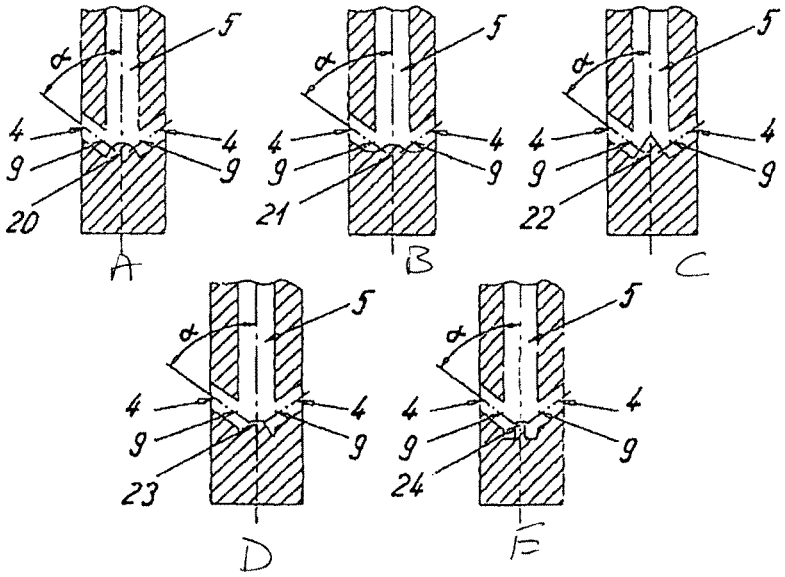
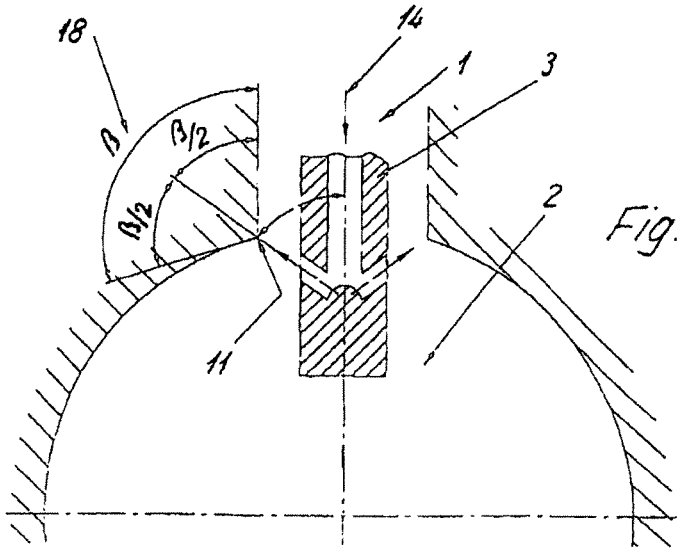
Fig. 4

NOZZLE AND METHOD FOR TREATING AN INTERIOR OF A WORKPIECE

The invention relates to a nozzle and to a method for treating an interior of a workpiece.

The demand for miniaturization, for increasing the power density and for saving weight changes the design of many workpieces, in particular of machine components, and the methods of producing them.

Thus, for example, bores and flow passages in series-produced components for injection systems of engines are becoming increasingly smaller and the materials used are becoming increasingly stronger on account of the high demands.

When producing such parts by machining, burrs are always produced at intersections of bores and steps which are not accessible for mechanical deburring tools. Chips, small particles and dirt residues remain in the workpiece and cannot be removed with conventional methods or can only be removed inadequately. At the same time, however, the demands for cleanliness and for a defined surface quality are increasing in order to be able to ensure the reliability of the components in operation over the entire life cycle of the product.

The prior art discloses methods of cleaning and deburring in which liquid jets are produced by means of nozzles which are located outside the workpiece. The liquid jets are emitted into the bores and openings. The fluid medium, preferably water or emulsions, which discharges under high pressure from nozzle passages, is supposed to loosen dirt and burrs on the inner surface of the bores and openings on account of the high kinetic energy of the medium.

In another method, particles having an abrasive action, such as corundum for example, are used in conjunction with the medium. An effective high velocity of the discharging liquid jet is achieved by preceding high-pressure expansion.

These particles are deflected in the workpiece by baffle pieces, such that they strike the surface region to be treated and become effective there.

The known methods all have serious disadvantages, which do not meet the requisite demands for quality of the treatment to the desired extent.

In addition, the effect of the nozzles used outside the workpiece is unsatisfactory. Firstly, there is poor transformation of energy due to the considerable distance between the nozzle and the surface to be treated. Secondly, the high-pressure jets are disturbed by the liquid flowing off.

Furthermore, damping effects due to water cushions impair the treatment process, as does the fact that critical zones cannot be directly subjected to the jets. Thus, for example, only fluttering or dangling burrs in larger bores can be reliably removed. The removal of root burrs is virtually impossible on account of the poor transformation of energy.

Such use of particles having an abrasive effect leads to wear of the baffle pieces to be used, the handling of which is in addition relatively complicated and is an obstacle to efficient production.

In addition, contamination and clogging often occurs due to the abrasive particles, such that high operating costs arise overall.

The known possibilities for the treatment of an interior of a workpiece do not meet the demands for series production.

The object of the invention is therefore to develop a nozzle and a method of the generic type in such a way that treatment which meets the demands is possible, and at the same time improved service life of the nozzle.

In combination with the novel nozzle, the method is able to optimally bring the kinetic energy into the region where it effectively alters the surface in the desired manner.

This may be specific roughening, for example for the preparation for a coating, removal of firmly adhering dirt or a firmly adhering layer, or the removal of a root burr connected firmly and circumferentially to a contour to be deburred. Since, as mentioned, this has not been possible in a hitherto appropriate manner, the invention is of considerable importance in the production process for injection components for the automobile industry.

According to the invention, the novel nozzle has at least one nozzle passage, but preferably at least two nozzle passages, which are located opposite one another and extend, starting from the bottom end region of the feed bore, at an angle less than or equal to 90° to the feed bore in the inflow direction. In this case, the bottom of the feed bore is partly raised, so as to constrict the transition region to the nozzle passage.

Due to the constriction of the cross section, the medium is directed in such a way that cavitation within the nozzle passage and erosion wear at the outlet of the nozzle passage are largely avoided. This means that the discharging liquid jet maintains its form and direction in a stable manner. As has surprisingly been shown, the service life of such a nozzle is significantly increased, such that it represents remarkable progress compared with the prior art.

The raised design of the bottom of the feed bore can be formed in a large variety of different ways. The prominence or projection is expediently formed centrally.

Figure 2:
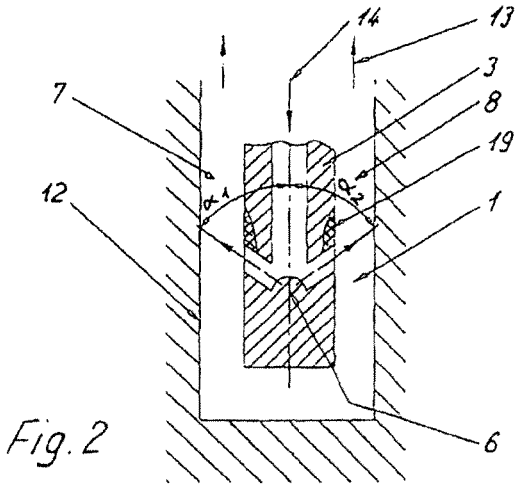
Figure 5:
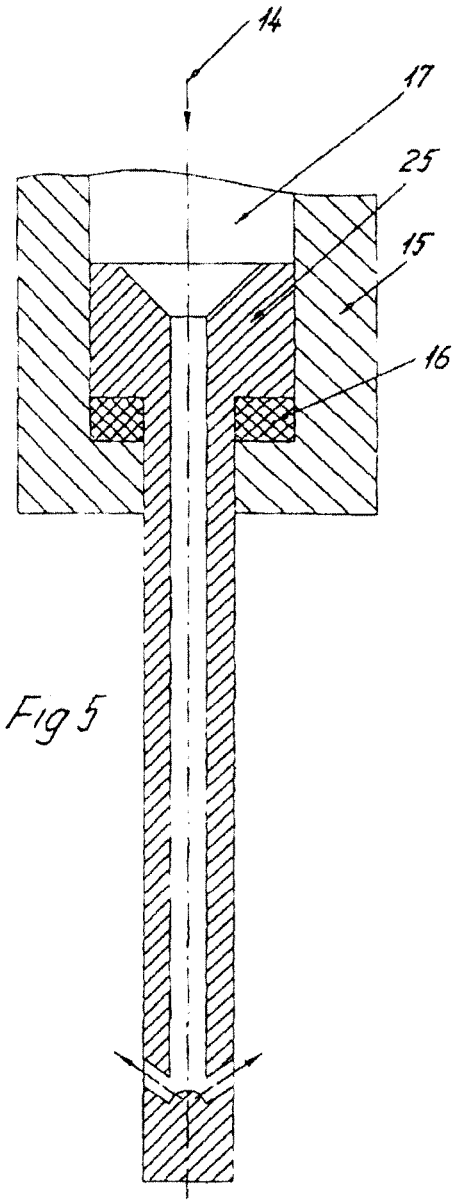
Figure 6:
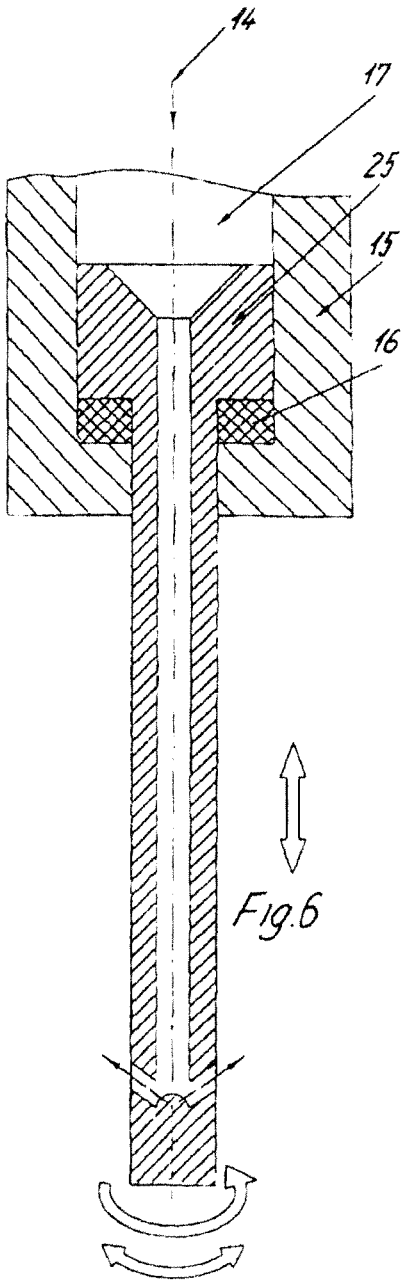

Exemplary embodiments of the invention are described below with reference to the attached drawings, Brief Description of the Drawings:

FIGS. 1 and 2 each show a nozzle according to the invention in different treatment cases, in a sectioned side view, FIGS. 3A-3D shows various exemplary embodiments of the nozzle, likewise in sectioned side views, FIG. 4 shows a nozzle in a further functional position in a sectioned side view, FIGS. 5 and 6 show a fitted nozzle, in each case in a longitudinal section.

DETAILED DESCRIPTION OF THE DRAWINGS

Shown in the figures is a nozzle which is provided overall with the designation 3 and with which an interior 1, 2 of a workpiece can be treated.

The nozzle 3 shown in the exemplary embodiments has two opposite nozzle passages 4, from which a fluid medium under high pressure fed via a central feed bore 5, is discharged.

In this case, the nozzle passages 4, starting from the bottom end region of the feed bore 5 designed as a blind hole, extend at an angle less than or equal to 90° to the feed bore 5 in the inflow direction 14.

The bottom of the feed bore 5 has a prominence or projection which is provided with the designation 6 in the example shown in FIGS. 1 and 2. The prominence 6 extends into the nozzle passage 4 and is located adjacent an exit of the nozzle 3. The prominence 6 in the exemplary embodiment shown in FIG. 3A-3D, respectively, is designed to be spherical 20, bell-shaped 21, conical 22, frustoconical 23 and cylindrical 24. The prominence 6 extends into the nozzle passage 4 and is located adjacent an exit of the nozzle 3. The prominence 6 constricts the transition region from the feed bore 5 to the nozzle passages 4.

In FIG. 1, the interior 1 opens into the interior 2. A root burr developed in the region of the common edge 10, 11 during the production. This root burr is being removed by the liquid jet discharging from the nozzle passages 4.

In the process, a pump (not shown) sets the liquid medium, normally water or an emulsion, under a pressure of 400 to 4000 bar, preferably 1500 to 2500 bar. The pressure is expanded in the nozzle passages 4, with the potential energy being converted into kinetic energy. The liquid jet strikes the edges 10, 11 or the root burr present there at high velocity and removes the root burr, until the desired edge form is achieved.

The acute-angled conduction of the flow, in conjunction with the constriction of the transition region to the nozzle passages, ensures that wear zones 19 inside the nozzle passages or at the passage outlet do not form or form only very slowly. The angles $\alpha_1$ and $\alpha_2$, at which the nozzle passages 4 run, are provided with designations 7 and 8 in FIGS. 1 and 2.

The use of the nozzle for the surface treatment of the interior 1 is shown in FIG. 2.

The arrangement or extent of the nozzle passages 4 corresponds to that shown in FIG. 1.

In addition to the suppression of the wear in the zones 19, a favorable return flow 13 of the fluid back up the interior 1 flowing off is achieved by the acute passage angles 7, 8.

In this case, no cushion forms between the liquid jet and the surface 12, to be treated, of the interior 1, such that residues are reliably flushed out.

The shape and precise position of the embodiment variants of the prominences 6 and 20 to 24 depend on the parameters medium pressure, volumetric flow, diameter of the feed bore 5 and the number and the diameters of the nozzle passages 4.

The transition from the interior 1 of smaller cross section to the interior 2 of larger cross section of a work piece is shown in FIG. 4. Optimum results with respect to the quality and treatment time during the treatment of the edge 11 for removing a root burr are achieved if the liquid jet leaves the nozzle passages 4 at an angle $\alpha$ which corresponds to a half angle $\beta$ (designation 18). If the edge 11 varies over the length, the optimum angle $\alpha$ should correspond to the arithmetic mean of the maximum and the minimum edge angle $\beta$18.

It can be seen in FIGS. 5 and 6 that the nozzle 3 is designed as a lance nozzle which has a collar 25 on its side remote from the nozzle passages 4. The collar 25 rests in a bearing opening 17 of a nozzle holder 15.

The collar 25 bears with its underside on a seal 16, which is positioned at the base of the bearing opening 17.

If a hydraulic pressure builds up, the pressure acts on the collar 25 and the seal 16. This automatically achieves a sealing pressure which corresponds to the ratio of the circular area of the collar 25 to the annular area of the seal 16 multiplied by the applied pressure.

The nozzle 3 is therefore not preloaded by an externally applied preloading force, a factor which could be unfavorable for the orientation of the nozzle 3 and thus for the accuracy of the method.

Since the nozzle 3 can be moved axially against the inflow direction 14, the nozzle 3 is protected against collision in the pressureless state if the nozzle were to strike an obstacle or be incorrectly positioned when advancing.

As illustrated by FIG. 6, the nozzle 3 can be set in a rotary motion by a rotary drive and can be operated at speeds within the range of 50 to 3000 rev/min, preferably 200 to 1500 rev/min, depending on the nature of the task and on the material to be treated. The nozzle 3 can perform a swiveling motion about the longitudinal axis and/or an oscillating stroke movement by means of a robot.

In the case of intersecting interiors 1, 2 and intersecting edges 10, 11, the nozzle 3 is inserted for the deburring into the respectively smaller interior 1, the smallest diameter of which lies within the range of 1 to 30 mm, preferably within the range of 2 to 10 mm.

Thus, the present invention relates to a method to debur a surface of an interior of a workpiece by a nozzle using a high pressure fluid medium. The nozzle includes at least one nozzle passage branching off from a feed bore. The at least one nozzle passage, starting from a bottom end region of the feed bore, extends at an angle less than or equal to 90° to the feed bore in the inflow direction. The bottom end region of the feed bore includes a prominence which extends into the at least one nozzle passage and which constricts a transition region between the feed bore and the prominence located adjacent an exit of the nozzle and the at least nozzle passage. The method includes the steps of directing the nozzle onto the interior surface, discharging the fluid medium from the at least one nozzle passage directly onto the interior surface, and deburring the interior surface of the workpiece. And, wherein the fluid medium discharging from the nozzle is admitted directly onto a burr formed at an edge between two interior surfaces. And further wherein, when the burr formed at the edge is acted upon, the fluid medium strikes the burr at an angle which corresponds to an angle bisector, in a radial section, of the edge.

In addition, a spatially altered angle of the edge, a direction of the fluid medium corresponds to a mean of the maximum and minimum angles, in the radial section, of the angle bisector of the edge.

Although the present invention has been described and illustrated in detail, it is to be clearly understood that the same is by way of illustration and example only, and is not to be taken by way of limitation. The scope of the present invention are to be limited only by the terms of the appended claims.

The invention claimed is:

1. A method to debur a surface of an interior of a workpiece by a nozzle using a high pressure fluid medium, the nozzle including:

at least one nozzle passage branching off from a feed bore;

the at least one nozzle passage, starting from a bottom end region of the feed bore, extending at an angle less than or equal to 90° to the feed bore in the inflow direction; and the bottom end region of the feed bore including a prominence which extends into the at least one nozzle passage and which constricts a transition region between the feed bore and the prominence located adjacent an exit of the at least one nozzle and the nozzle passage; and the method including the steps of directing the nozzle onto the interior surface, discharging the fluid medium from the at least one nozzle passage directly onto the interior surface, and deburring the interior surface of the workpiece;

wherein the fluid medium discharging from the nozzle is admitted directly onto a burr formed at an edge between two interior surfaces; and wherein, when the burr formed at the edge is acted upon, the fluid medium strikes the burr at an angle which corresponds to an angle bisector, in a radial section, of the edge.

2. The method as claimed in claim 1, wherein the prominence is one of spherical, bell-shaped, conical, frustoconical and cylindrical.

3. The method as claimed in claim 1, wherein the prominence is arranged centrally.

4. The method as claimed in claim 1, further comprising two nozzle passages that are provided opposite one another.

5. The method as claimed in claim 1, wherein the nozzle is designed as a lance nozzle which is mounted in a nozzle holder.

6. The method as claimed in claim 5, wherein the nozzle has a collar at an end remote from the nozzle passage, the collar resting in a bearing opening of the nozzle holder.

7. The method as claimed in claim 6, wherein a seal is arranged between the collar and a base of a bearing opening.

8. The method as claimed in claim 5, wherein the nozzle is mounted in the nozzle holder in an axially movable manner.

9. The method as claimed in claim 5, wherein the nozzle is one of rotatable together with the nozzle holder, is swivelable about its longitudinal axis and is movable in an oscillating manner in an axial direction.

10. The method as claimed in claim 1, wherein, in a spatially altered angle of the edge, a direction of the fluid medium corresponds to a mean of the maximum and minimum angles, in the radial section, of the angle bisector of the edge.

11. The method as claimed in claim 1, wherein the nozzle, in a functional position, is pressed automatically onto a seal in a nozzle holder by hydraulic pressure.

12. The method as claimed in claim 1, wherein a pressure of the fluid medium is 400 to 4000 bar.

13. The method as claimed in claim 1, wherein the nozzle rotates at a speed of 50 to 3000 revolutions per minute.

14. The method as claimed in claim 1, wherein the pressure of the fluid medium is 1500 to 2500 bar.

15. The method as claimed in claim 1, wherein the nozzle is rotated at a speed of 200 to 1500 revolutions per minute.

* * * * *